US011388998B2

(12) United States Patent
Murphy

(10) Patent No.: US 11,388,998 B2
(45) Date of Patent: Jul. 19, 2022

(54) RECLINING SEATING UNIT WITH WALL-PROXIMITY CAPABILITY AND EXTENDABLE HEADREST

(71) Applicant: Ultra-Mek, inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 16 days.

(21) Appl. No.: 17/065,586

(22) Filed: Oct. 8, 2020

(65) Prior Publication Data

US 2021/0022506 A1 Jan. 28, 2021

Related U.S. Application Data

(63) Continuation-in-part of application No. 16/538,933, filed on Aug. 13, 2019, now Pat. No. 11,140,988.
(Continued)

(51) Int. Cl.
*A47C 1/0355* (2013.01)
*A47C 1/037* (2006.01)

(52) U.S. Cl.
CPC ..... *A47C 1/0355* (2013.01); *A47C 1/037* (2013.01)

(58) Field of Classification Search
CPC ..... A47C 1/0355; A47C 1/037
See application file for complete search history.

(56) References Cited

U.S. PATENT DOCUMENTS 4,077,663 A 3/1978 Cycowicz et al.
4,337,977 A 7/1982 Rogers et al.
(Continued)

FOREIGN PATENT DOCUMENTS

GB 2205489 A 12/1988
WO 0221973 A1 3/2002

OTHER PUBLICATIONS

"International Preliminary Report on Patentability corresponding to International Application No. PCT/US2019/061380 dated Jun. 10, 2021".
"Extended European Search Report corresponding to European Application No. 19889632.6 dated Oct. 27, 2021".
"International Search Report and Written Opinion corresponding to International Application No. PCT/US2019/061380 dated Mar. 26, 2020".
(Continued)

*Primary Examiner* — Anthony D Barfield
(74) *Attorney, Agent, or Firm* — Myers Bigel, P.A.

(57) ABSTRACT

A wall-proximity reclining seating unit includes: a frame having a back member and a pair of arms, the back member extending between the arms; a backrest; a seat; a first footrest; and a reclining mechanism connected between the frame, backrest, seat, and first footrest. The reclining mechanism comprises a series of pivotally interconnected links and is configured to move the seating unit between: (a) an upright position, (b) a TV position, in which the first footrest is extended in front of the seat and is generally horizontally disposed, and the seat and backrest are moved forwardly relative to the frame; and (c) a fully reclined position, in which the first footrest remains extended in front of the seat, and the seat is moved forward of its position in the TV position. The seating unit also includes a headrest mechanism attached to the headrest and the backrest, the headrest mechanism configured to move the headrest between a retracted position, in which the headrest is generally horizontally disposed and overlies the backrest and the back member, and an extended position, in which the headrest is generally upright and generally parallel with the backrest.

12 Claims, 21 Drawing Sheets

Related U.S. Application Data

(60) Provisional application No. 62/771,321, filed on Nov. 26, 2018.

(56) References Cited

U.S. PATENT DOCUMENTS

| | | | | |
|---|---|---|---|---|
| 4,531,778 | A | 7/1985 | Rogers | |
| 4,805,960 | A | 2/1989 | Tacker | |
| 5,340,191 | A * | 8/1994 | May | A47C 1/0355 297/403 |
| 5,346,277 | A * | 9/1994 | Holobaugh | 297/396 |
| 5,374,100 | A * | 12/1994 | Rogers | A47C 1/0345 297/391 |
| 5,588,710 | A | 12/1996 | Glenn | |
| 5,823,614 | A | 10/1998 | Johnson et al. | |
| 5,954,392 | A | 9/1999 | Liss et al. | |
| 5,992,930 | A | 11/1999 | LaPointe et al. | |
| 8,752,890 | B2 | 6/2014 | Murphy et al. | |
| 8,833,844 | B2 * | 9/2014 | LaPointe | 297/85 M |
| 2008/0036248 | A1 | 2/2008 | Murphy et al. | |
| 2008/0258512 | A1 * | 10/2008 | Rogers | A47C 7/402 297/61 |
| 2011/0304193 | A1 | 12/2011 | Murphy et al. | |
| 2012/0104827 | A1 | 5/2012 | Murphy et al. | |

OTHER PUBLICATIONS

"Extended European Search Report corresponding to European Application No. 19889632.6 dated Dec. 16, 2021".

* cited by examiner

RECLINING SEATING UNIT WITH WALL-PROXIMITY CAPABILITY AND EXTENDABLE HEADREST

RELATED APPLICATION

This application is a continuation-in-part of U.S. patent application Ser. No. 16/538,933, filed Aug. 13, 2019, now U.S. Pat. No. 11,140,988, which claims priority from and the benefit of U.S. Provisional Patent Application No. 62/771,321, filed Nov. 26, 2018. The disclosures of each of these documents are hereby incorporated herein by reference in full.

FIELD OF THE INVENTION

The present invention relates generally to seating units, and relates more particularly to reclining seating units.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular reclining chair is the so-called "wall-proximity" chair. In a conventional reclining chair, as the backrest moves to the reclined position, the upper end of the backrest moves rearwardly relative to the base of the chair. As a result, typically the chair cannot be positioned such that the backrest is adjacent a wall, as the reclining backrest would strike the wall and thereby be prevented from fully reclining. A "wall-proximity" reclining chair includes some type of mechanism (typically either a linkage or a set of wheels that roll on a track) that move the seat of the chair forward relative to the base to provide additional room for the backrest to recline. Typically, such chairs are configured so that the seat and backrest move forward relative to the base when the chair moves from an upright position to a partially reclined "TV" position, in which the footrest is extended. The seat and backrest then move farther forward relative to the base as the chair from the TV position to its fully reclined position. Exemplary wall-proximity chairs are illustrated in U.S. Pat. No. 4,077,663 to Cycowicz et al., U.S. Pat. No. 4,337,977 to Rogers et al., U.S. Pat. No. 4,531,778 to Rogers, U.S. Pat. No. 4,805,960 to Tacker, U.S. Pat. No. 5,588,710 to Wiecek, and U.S. Pat. No. 5,992,930 to LaPointe et al., and in U.S. Patent Publication No. 20080036248 to Murphy et al., the disclosures of each of which are hereby incorporated herein in their entireties. A typical wall-proximity chair in its upright position can be placed with the backrest within 3 to 4 inches of an adjacent wall and still avoid striking the adjacent wall when moved to the fully reclined position.

One potential shortcoming of wall-proximity chairs is that the wall-proximity mechanism or wheel/rail system is typically somewhat complex, with multiple interconnected intricate parts. As such, production of these mechanisms can be relatively expensive. Also, the mechanisms that control the movement of wall-proximity chairs tend to be rather bulky, and therefore may be unsuitable for some specialized chairs. For example, some chairs have a "high leg" style in which the arms of the chair are raised several inches off of the underlying surface (typically between about 4 and 9 inches). It is ordinarily undesirable for portions of a reclining mechanism to be visible in the space below the chair when the chair is in the upright position, so the designers are faced with providing a reclining mechanism that folds into a relatively small package that is not visible from the side in the upright position.

SUMMARY

As a first aspect, embodiments of the invention are directed to a wall-proximity reclining seating unit. The seating unit comprises: a frame having a back member and a pair of arms, the back member extending between the arms; a backrest; a seat; a first footrest; a reclining mechanism connected between the frame, backrest, seat, and first footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the first footrest is retracted below a forward portion of the seat, (b) a TV position, in which the backrest substantially maintains the first backrest angle, the seat is disposed at a second seat angle that is steeper than the first seat angle, the first footrest is extended in front of the seat and is generally horizontally disposed, and the seat and backrest are moved forwardly relative to the frame; and (c) a fully reclined position, in which the backrest is disposed at a second backrest angle that is shallower than the first backrest angle, the first footrest remains extended in front of the seat, and the seat is moved forward of its position in the TV position; a headrest; and a headrest mechanism attached to the headrest and the backrest, the headrest mechanism configured to move the headrest between a retracted position, in which the headrest is generally horizontally disposed and overlies the backrest and the back member, and an extended position, in which the headrest is generally upright and generally parallel with the backrest, the headrest mechanism including a drive member having upper and lower segments that are slidably connected with each other, such that the headrest is free to pivot away from the retracted position.

DETAILED DESCRIPTION

Figure 1:
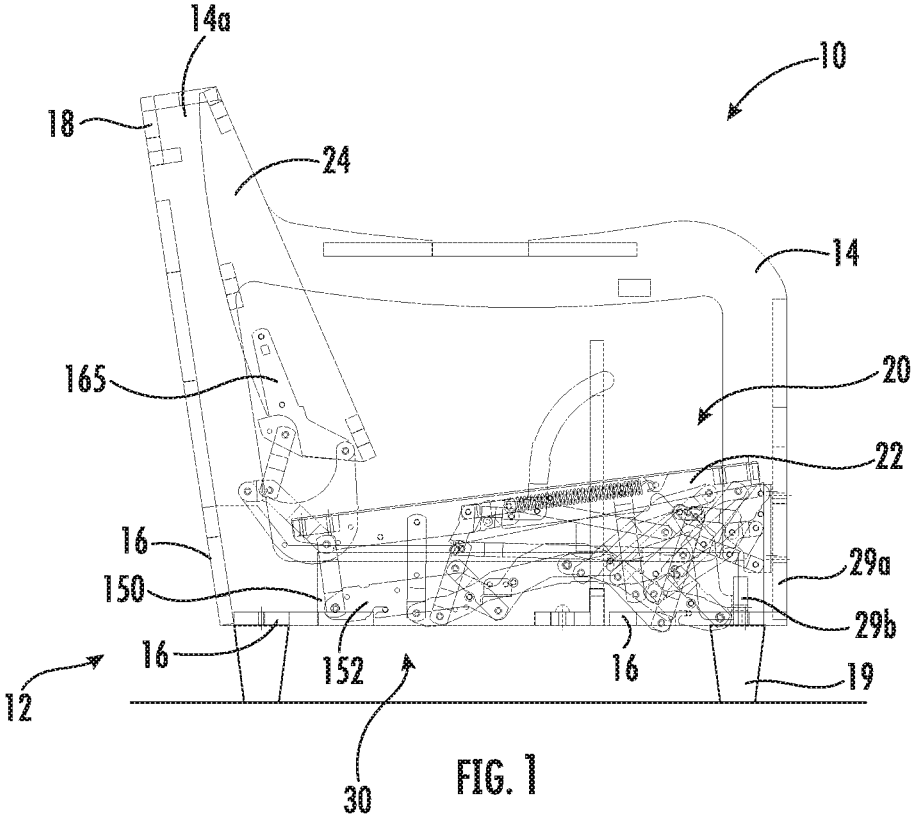
FIG. 1 is a side view of a wall-proximity reclining chair according to embodiments of the invention, the chair shown in the upright position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, a reclining wall-avoiding chair, designated broadly at 10, is shown in FIGS. 1-6. The chair 10 includes a frame 12 having two opposed arms 14 connected by multiple cross-members 16. Specifically, the frame 12 includes an upper cross-member 18 that spans upper end portions 14*a* of the arms 14, and is supported by feet 19, which may be at least 4 inches in height. The chair also includes a seat 20 with a cushion (not shown) that overlies a seat frame 22, a backrest 24, and main and auxiliary footrests 29*a*, 29*b*.

The seat 20, the backrest 24 and the footrests 29*a*, 29*b* are interconnected by two mirror image reclining mechanisms 30. The mechanisms 30 are mirror images of each other about a longitudinal plane that divides the chair into left and right sides. As such, only one reclining mechanism 30 will be discussed in detail herein, with the understanding that the discussion is equally applicable to its mirror image mechanism. Also, the reclining mechanism 30 will be described first with respect to the fully reclined position (FIGS. 3 and 6) in order to illustrate more easily the interconnection of the various links thereof.

The reclining mechanism 30 includes a foundation link 152 is fixed to the inner surface of the arm 14*a* to provide mounting locations for multiple links of the reclining mechanism 30. A lower rear swing link 154 is mounted to the foundation link 152 at a pivot 156 and extends forwardly and slightly upwardly therefrom. An angled upper rear swing link 158 is attached at its lower end to the lower rear swing link 154 at a pivot 160 and extends upwardly and slightly forwardly therefrom. A control link 162 is attached at its lower end to the vertex of the upper rear swing link 158 at a pivot 164 and extends upwardly and slightly forwardly to a pivot 166 with a backpost 165 fixed to the backrest 24. A saddle-shaped extension 168 is fixed to the rear end of the seat frame 22; the extension 168 is attached to the backpost 165 at a pivot 172 and to the upper end of the upper rear swing link 158 at a pivot 170.

A rear recline link 174 is attached to the foundation link 152 at a pivot 176 and extends upwardly and slightly forwardly therefrom. A transition link 178 is attached in an intermediate location to the upper end of the rear recline link 174 at a pivot 180. The lower end of the transition link 178 is attached to a carrier link 190 at a pivot 194. The upper end of the transition link 178 is attached at a pivot 184 to the rear end of a coupling link 182.

A front recline link 208 is attached at its lower end to the forward end of the foundation link 152 at a pivot 212. At its upper end, the front recline link 208 is attached to an intermediate location of a drawing link 186 at a pivot 206. The drawing link 186 is attached at its lower end to the carrier link 190 at a pivot 192. The forward end of the coupling link 182 is attached to a central position on the drawing link 186 at a pivot 189. At its upper end, the drawing link 186 is attached to a drive link 214 at a pivot 216. The drive link 214 is attached at its rear end to the foundation link 152 at a pivot 218. A rear seat swing link 196 is attached to the rear end of the carrier link 190 at a pivot 198 and to the seat frame 22 at a pivot 200. A forward seat swing link 202 is attached to the carrier link 190 at a pivot 207 and to the seat frame 22 at a pivot 204.

Figure 3:
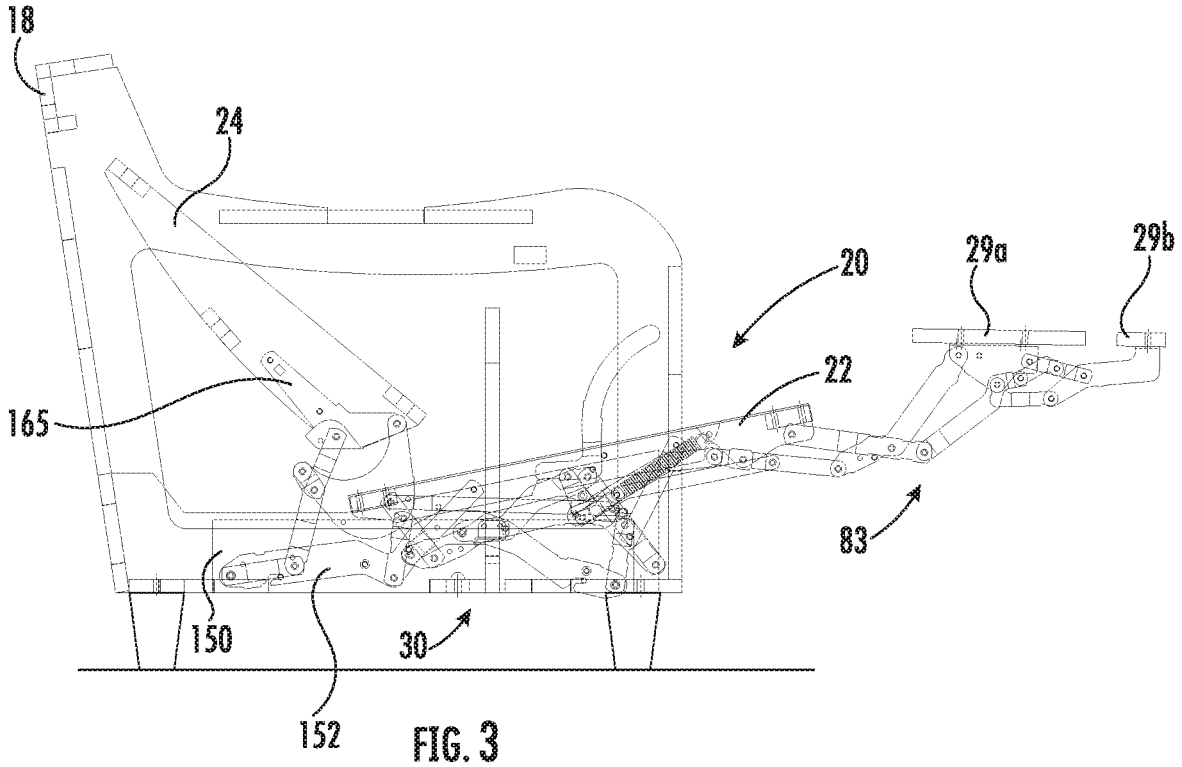
FIG. 3 is a side view of the chair of FIG. 1 shown in the fully reclined position.

The reclining mechanism 30 also includes a footrest linkage 83 with a lower footrest swing link 84 that is attached to the seat frame 22 at a pivot 85 and extends forwardly therefrom. The lower footrest swing link 84 is also attached at its upper end to a footrest drawing link 138 at a pivot 145 and to a footrest drive link 140 at a pivot 141. The footrest drawing link 138 is also attached to the carrier link 190 at a pivot 146. An upper footrest swing link 88 is also attached to the seat frame 22 at a pivot 90 and extends forwardly therefrom. An upper footrest extension link 92 is attached to the forward end of the lower footrest swing link 84 at a pivot 94 and extends upwardly and forwardly therefrom. The upper footrest extension link 92 is also attached to the upper footrest swing link 88 at a pivot 93. A lower footrest extension link 96 is attached to the forward end of the upper footrest swing link 88 at a pivot 98 and extends forwardly and upwardly therefrom. A main footrest bracket 100 is attached to the forward ends of the upper footrest extension link 92 and the lower footrest extension link 96 at, respectively, pivots 102, 104. The main footrest 29*a* is mounted on the main footrest bracket 100 (FIG. 3).

A lower auxiliary footrest swing link 110 is attached to the main footrest bracket 100 at the pivot 104, and an upper auxiliary footrest swing link 116 is attached to the main footrest bracket 100 at a pivot 118. An auxiliary footrest bracket 120 is attached to the front ends of the swing links 110, 116 at, respectively, pivots 122, 124. A control link 106 is attached to the forward end of the lower footrest extension link 96 at a pivot 108 and to the upper auxiliary footrest swing link 116 at a pivot 112. The auxiliary footrest 29*b* is mounted on the auxiliary footrest bracket 120 (FIG. 3).

Figure 6:
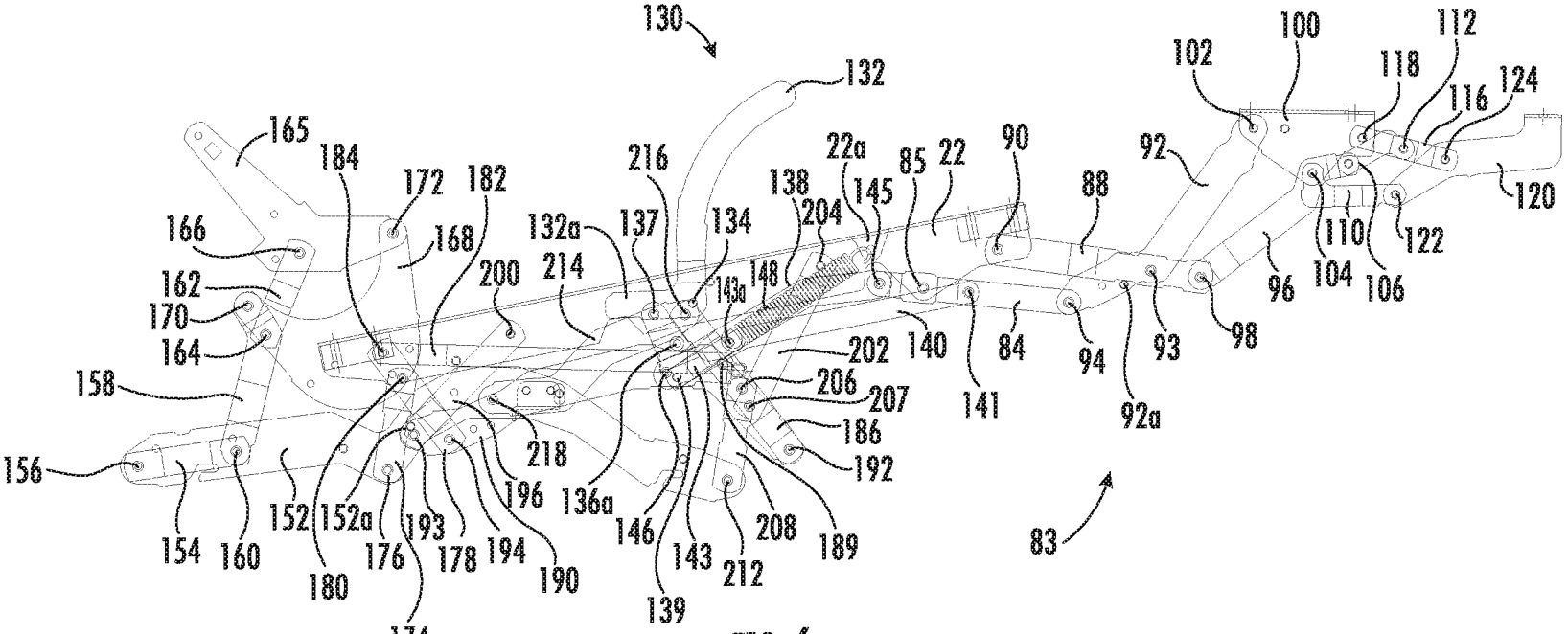
FIG. 6 is a side view of the mechanism of FIG. 4 shown in the fully reclined position.

Referring still to FIG. 6, an actuating mechanism 130 is coupled to the reclining mechanism 130 and includes a handle 132 attached to the seat frame 22 at a pivot 134. The handle 132 has a rear extension 132*a*. A bell crank 136 is attached to seat frame 22 at a pivot 137. A pin 136*a* extends transversely from the bell crank 136. A pin link 143 is fixed to the footrest drive link 140, which is attached at its rearward end to the bell crank 136 at a pivot 139. A spring 148 is attached to a pin 143*a* on the forward end of the pin link 143 and extends forwardly to a tab 22*a* on the seat frame 22.

Figure 4:
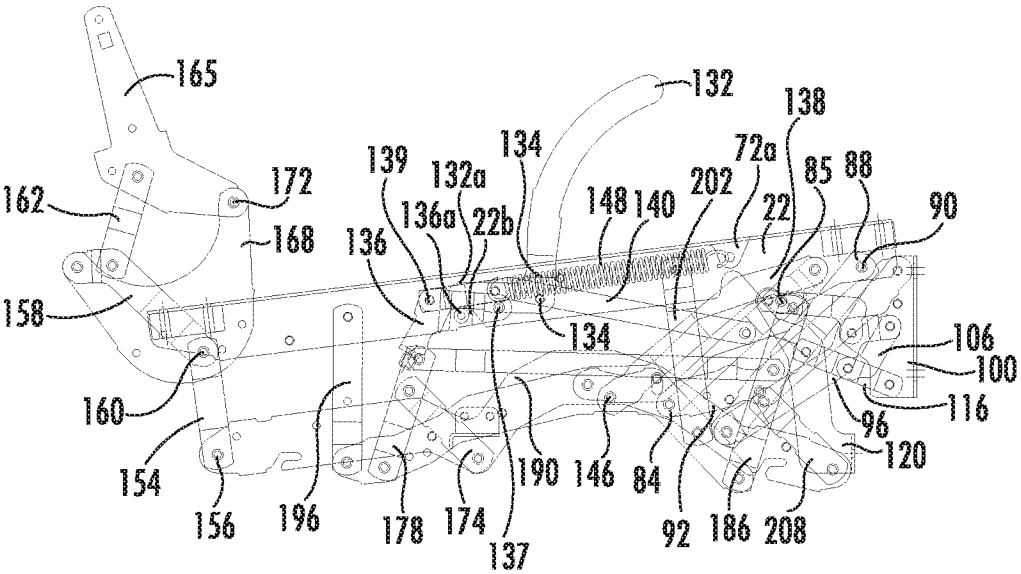
FIG. 4 is a side view of the reclining and footrest mechanism of the chair of FIG. 1 shown in the upright position.

Operation of the chair 10 typically commences with the chair 10 in the upright position of FIGS. 1 and 4. In the upright position, the footrest linkage 83 is folded under the front portion of the seat 20, with the main footrest 29*a* generally vertically disposed just forward of the seat 20, and the auxiliary footrest 29*b* generally vertically disposed rearward of the main footrest 29*a*. The rear seat swing link 196 and the forward seat swing link 202 are both disposed generally upright, but with a slight rearward lean. The rear recline link 174 and the front recline link 208 are also disposed generally upright, but with a more pronounced rearward lean. Both the transition link 178 and the drawing link 186 are tilted generally forwardly. The carrier link 190 is generally horizontal and generally centered longitudinally relative to the foundation bracket 152. The seat frame 22 has a slight pitch (between about 2 and 7 degrees). The backrest 24 is tilted slightly rearwardly (at an angle of between about 105 and 120 degrees relative to horizontal), with the upper portion of the backrest 24 adjacent the upper cross-member 18.

The chair 10 is maintained in the upright position by the actuating mechanism 130. The handle 132 is pivoted about the pivot 134 to a forward position, wherein the rear extension 132 is positioned above a recess 22*b* in the seat frame 22. The bell crank 136 is oriented so that the pin 136*a* resides in the recess 22*b*. This creates an "over-center" configuration between the pivots 139, 137 and 141. Tension in the spring 148 biases the actuating mechanism 130 toward the described orientation.

Figure 7:
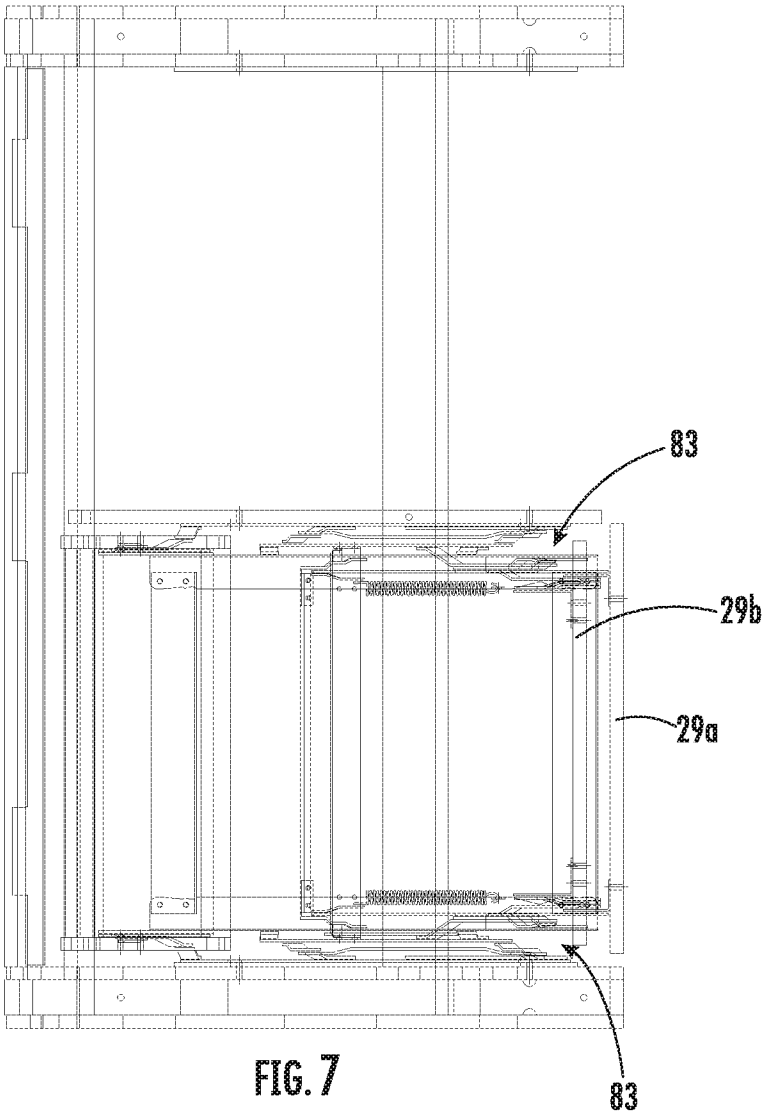
FIG. 7 is a top view of the chair of FIG. 1.
Figure 8:
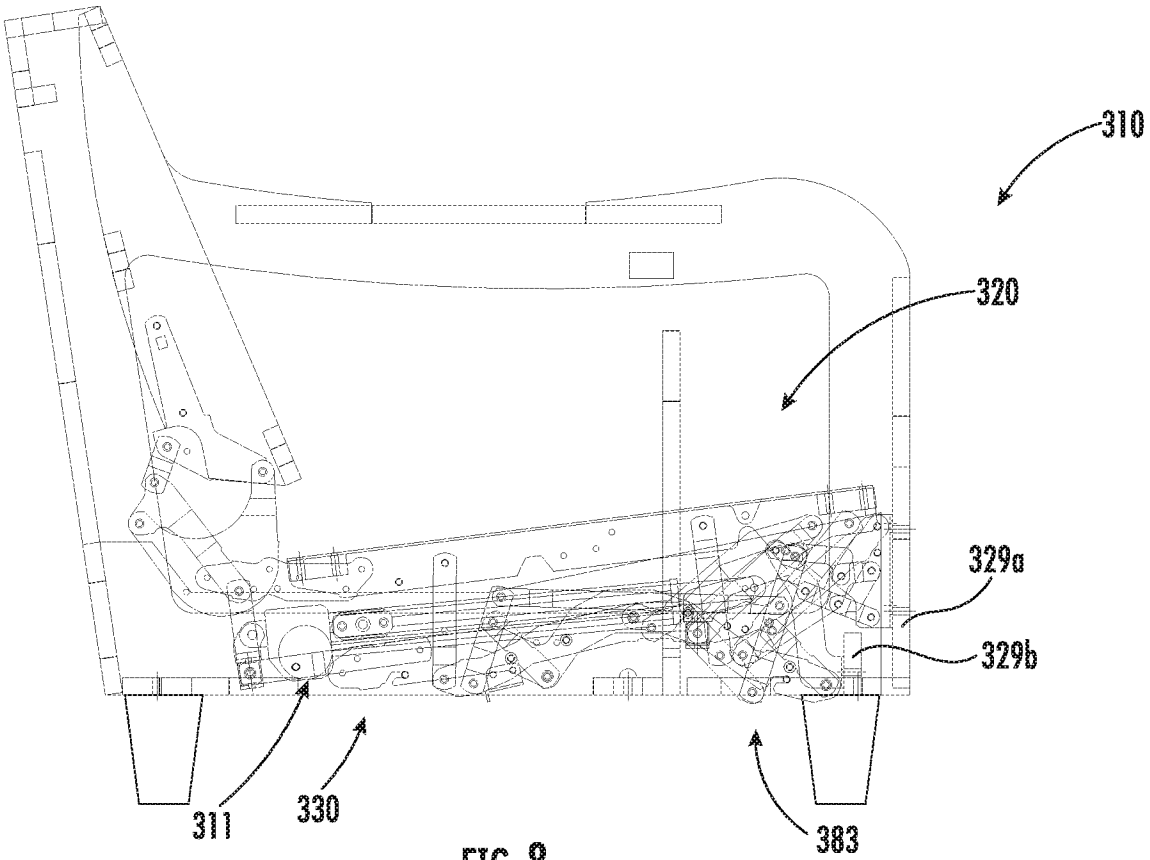
FIG. 8 is a side view of a wall-proximity reclining chair according to alternative embodiments of the invention, the chair shown in the upright position.

In some embodiments, the arrangement of the footrest mechanism 130 can enable the main and auxiliary footrests 29*a*, 29*b* to be the same (or nearly the same) width (e.g., substantially the full width of the chair 10). This arrangement is shown in FIG. 7, wherein the auxiliary footrest 29*b* is nearly the same width (within 1-2 inches) as the main footrest 29*a*. This is due to the fact that, in the upright position shown in FIGS. 1 and 4, there are no links of the reclining mechanism 30 positioned directly in front of the auxiliary footrest 29*b* that could prevent it from traveling forwardly (see also FIG. 7). This is in contrast to many prior chairs, in which the auxiliary footrest 29*b* is shorter in width than the main footrest 29*a* because links controlling the extension and retraction of the main footrest 29*a* are positioned directly in front of the auxiliary footrest 29*b* and therefore would interfere with its extension if the auxiliary footrest 29*b* were nearly as wide as the main footrest 29*a*.

Figure 2:
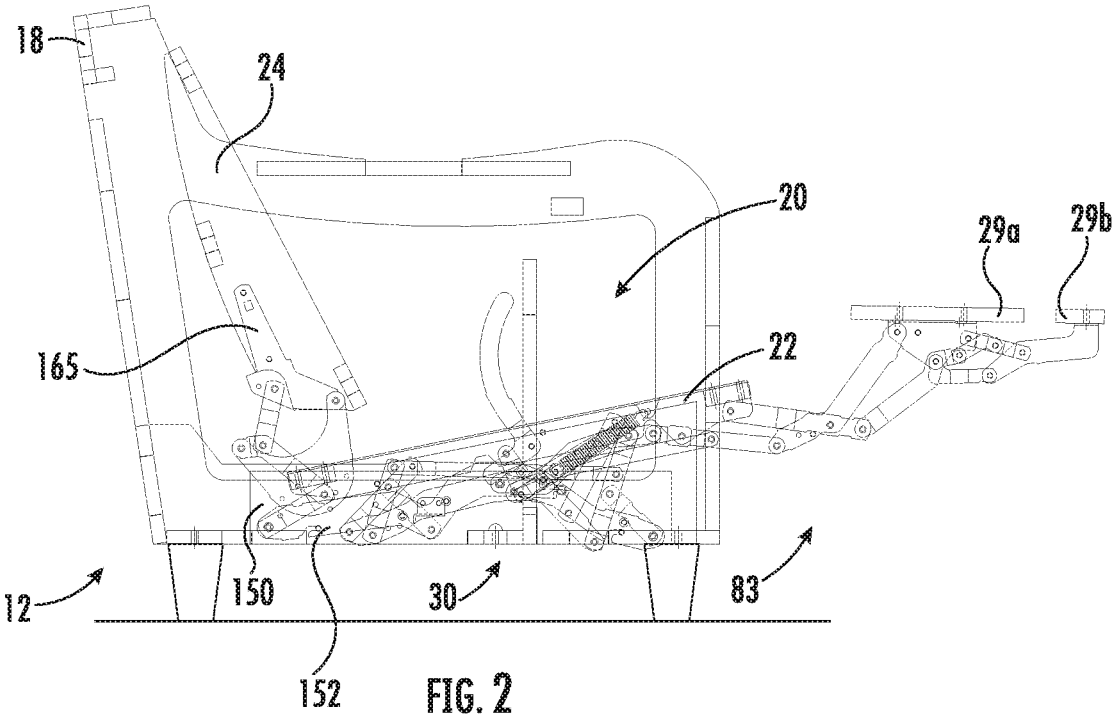
FIG. 2 is a side view of the chair of FIG. 1 shown in the TV position.
Figure 5:
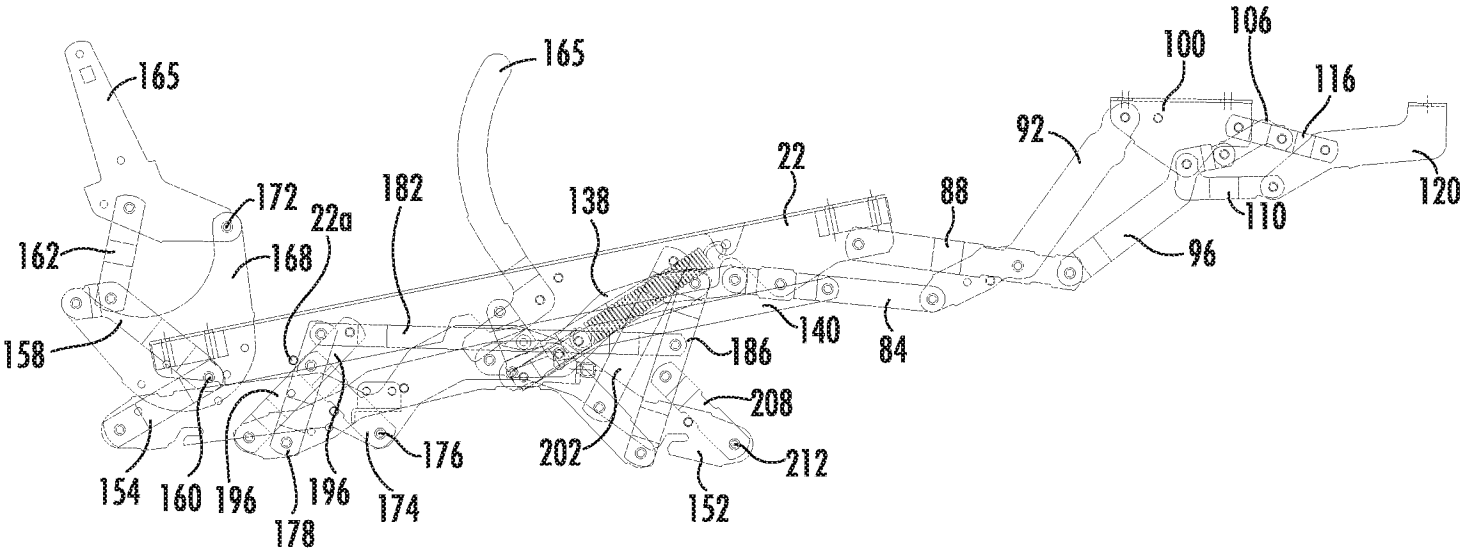
FIG. 5 is a side view of the mechanism of FIG. 4 shown in the TV position.

To move the chair 10 to the TV position of FIGS. 2 and 5, the occupant of the chair 10 pulls the upper end of the handle 132 rearwardly. This action pivots the handle 132 counterclockwise about the pivot 134, thereby driving the rear extension 132*a* into the pin 136*a* on the bell crank 136. The bell crank 136 rotates counterclockwise about the pivot 137, which forces the footrest drive link 140 forwardly. Forward movement of the footrest drive link 140 causes the lower footrest swing link 84 to rotate counterclockwise about the pivot 85. The movement of the lower footrest swing link 84 drives the upper footrest extension link 92 forwardly, which in turn rotates the upper footrest swing link 88 about the pivot 90. Rotation of the upper footrest swing link 88 drives the lower footrest extension link 96 forwardly and causes it to separate slightly from the upper footrest extension link 92. The relative movement of the upper and lower footrest extension links 92, 96 rotates the main ottoman bracket 100 counterclockwise to a generally horizontal position. Relative rotation of the main ottoman bracket 100 and the lower footrest extension link 96 also forces the control link 106 away from the main footrest bracket 100, which extends the upper auxiliary footrest swing link 116 and, in turn, the auxiliary footrest bracket 120. Extension ceases when the upper footrest swing link 88 strikes a pin 92*a* on the upper footrest extension link 92. Additional aspects of the extension of the footrests 29*a*, 29*b* may be discussed in U.S. Pat. No. 8,752,890 to Murphy et al., the disclosure of which is hereby incorporated herein by reference in its entirety.

In addition, rotation of the lower footrest swing link 84 creates a rearwardly-directed force on the footrest drawing link 138, which is also directed to the carrier link 190 at the pivot 146. However, the carrier link 190 is prevented from rearward movement by the weight of the occupant of the chair; thus, an oppositely-directed forward reaction force is imposed on the seat frame 22. As a result, the seat frame 22 (and the remainder of the seat 20) move forwardly relative to the carrier link 190 (and, in turn, relative to the base 12 along with the foundation link 152 mounted thereto). The forward movement of the seat frame 22 is controlled by the rear and front seat swing links 196, 202. The forward movement of the seat frame 22 also rotates the lower rear swing link 154 clockwise about the pivot 156. The rear end of the seat frame 22 descends, thereby increasing the pitch angle of the seat 20 by 2 to 10 degrees. This action ceases when a pin 22*a* on the seat frame 22 strikes the rear edge of the rear intermediate swing link 196.

Notably, the length and upright to slightly rearward disposition of the rear and front intermediate swing links 196, 202 enables the seat 20 to move forwardly a greater distance than previous chairs. In some embodiments, the forward movement of the seat 22 relative to the base 12 is between about 2.5 and 4 inches, which occurs with substantially no relative movement between the carrier link 190 and the base 12.

To move the chair 10 from the TV position of FIGS. 2 and 5 to the fully reclined position of FIGS. 3 and 6, the occupant of the chair forces the occupant's back into the backrest 24 (this may be augmented by the occupant pushing forwardly on the arms). This movement drives the backpost 165 (and backrest 24) counterclockwise about the pivot 172. This rotation first causes the lower rear swing link 154 to fully extend forwardly, at which point the upper rear swing link 158 rotates clockwise about the pivot 160. This movement raises the rear end of the seat frame 22 and forces it forwardly, and also causes the backrest 24 to move to a reclined position (i.e., a position with an increased angle relative to the seat 20).

In addition, because the seat frame 22 and carrier link 190 are unable to move relative to each other, forward movement of the seat frame 22 also drives the carrier link 190 forwardly relative to the foundation link 152. This movement is controlled by the rear recline link 174 and the front recline link 208, which pivot clockwise relative to the foundation link 152 about pivots 176, 212. The rotation of these recline links 174, 208 forces the carrier link 190 forward via the transition link 178 and the drawing link 186, which are attached to the carrier link 190. Forward movement of the carrier link 190 in turn moves the seat frame 22 forward. This movement continues until the rear recline link 174 contacts a pin 152*a* on the foundation link 152.

In moving from the TV position to the fully reclined position, the seat frame 22 moves forwardly relative to the base 12 between about 4 and 7 inches, which occurs with substantially no relative forward movement between the seat frame 22 and the carrier link 190. When this distance is combined with the forward movement of the seat frame 22 relative to the base 12 in moving from the upright position to the TV position, the total distance may be as much as 6.5 to 11 inches. Importantly, as can be seen in FIG. 3, this degree of movement can enable the backrest 24 to reach the fully reclined position even with the presence of the rear cross-member 18 (i.e., the uppermost end of the backrest 24 is positioned forwardly of the rear cross-member 18). As such, a chair according to embodiments shown herein can have wall-proximity capability even with a chair that has a fully formed back, which is often the case with chairs that are fully upholstered in the rear.

It should also be noted that the illustrated chair 10 is an "off-the-ground" high-leg style, such that there is space between the lower edges of the arms 14 and the underlying floor. It can be seen that the chair 10 has wall-proximity capability while still having a reclining mechanism 30 that folds into a sufficiently small "package" that the reclining mechanism 30 is not visible from the side of the chair 10 when the chair 10 is in the upright position.

In addition, this configuration also enables the use of a deeper seat frame 22, which can provide more room front-to-back for sitting, laying down, napping, etc. Further, in some embodiments, a unitary upholstery piece (e.g., a cushion or pad) can be used to cover the seat and the footrests 29*a* and to attach to the footrest 29*b*. As an example, the pad can be attached to the rear end of the seat 20, extend forwardly to cover the seat 20, extend downwardly to cover the front surface of the main footrest 29*a*, and extend below the main footrest 29*a* and rearwardly to attach to the upper edge of the auxiliary footrest 29*b*. Extension/retraction of the footrests 29*a*, 29*b* and forward movement of the seat 20 are such that the pad can remain taut, but not overstretch, as these components move between positions. Such a pad is shown at 470 attached to the chair 310 discussed in connection with FIGS. 8-13 below.

Figure 9:
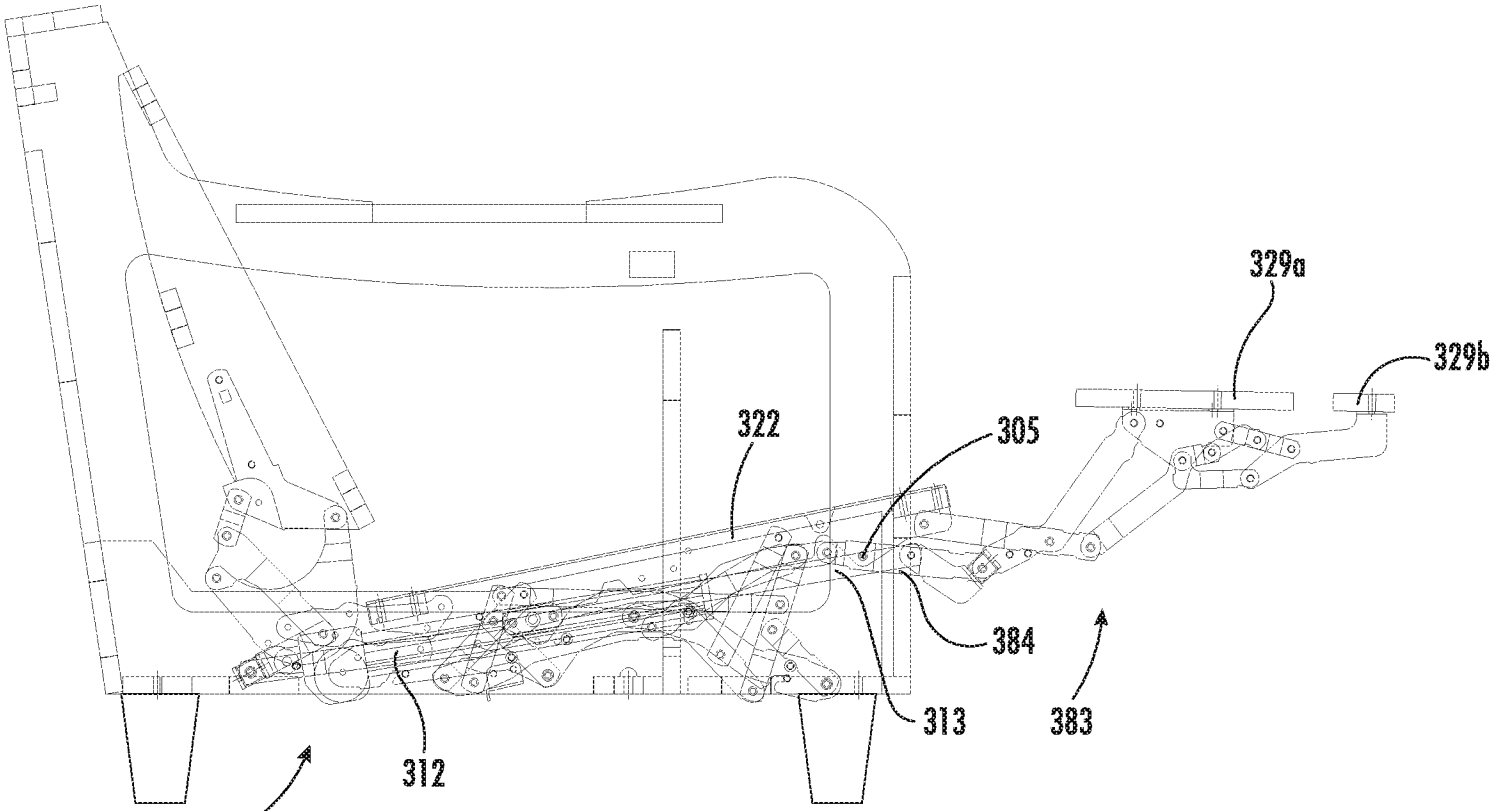
FIG. 9 is a side view of the chair of FIG. 8 shown in the TV position.
Figure 10:
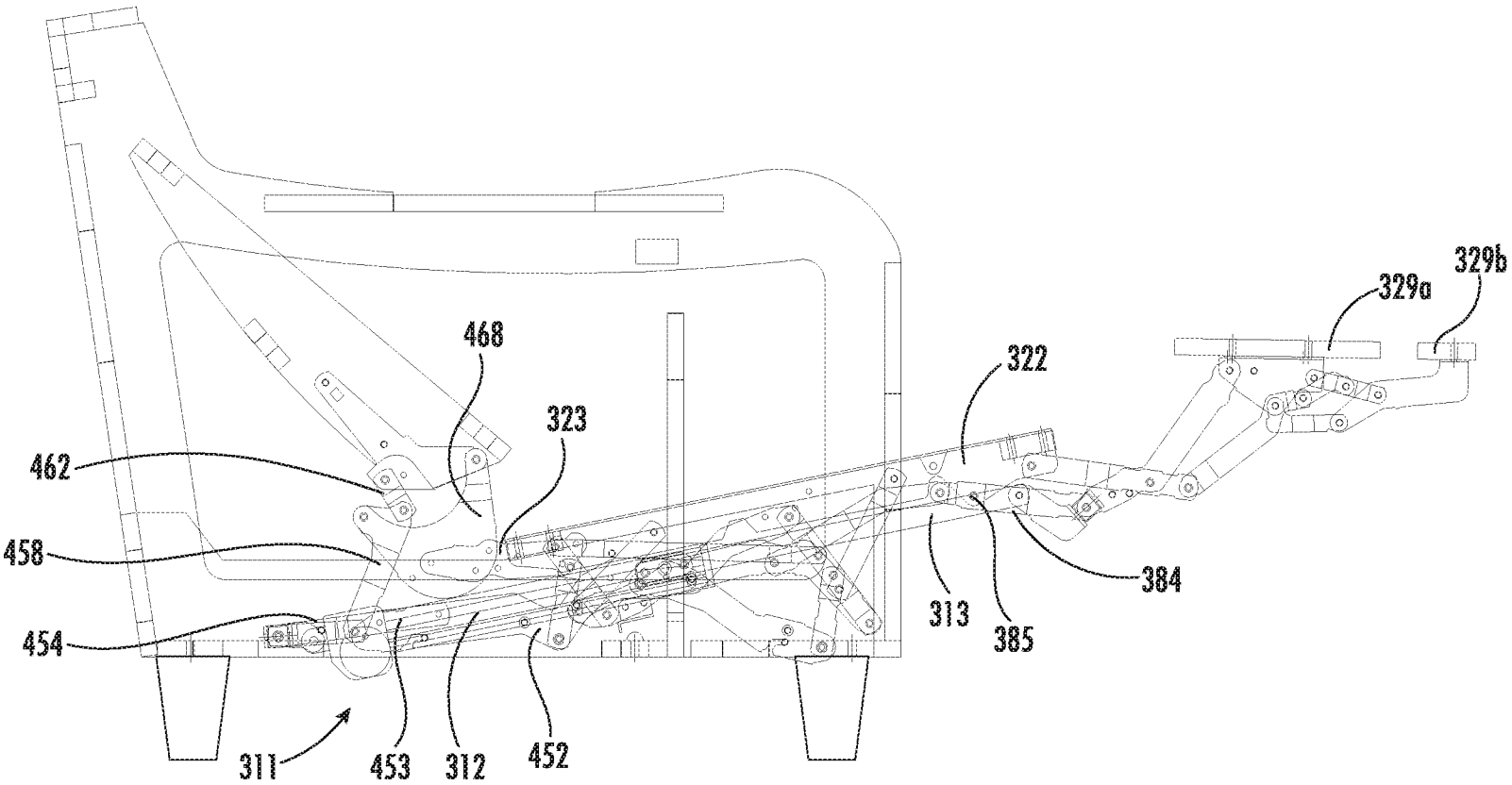
FIG. 10 is a side view of the chair of FIG. 8 shown in the fully reclined position.
Figure 11:
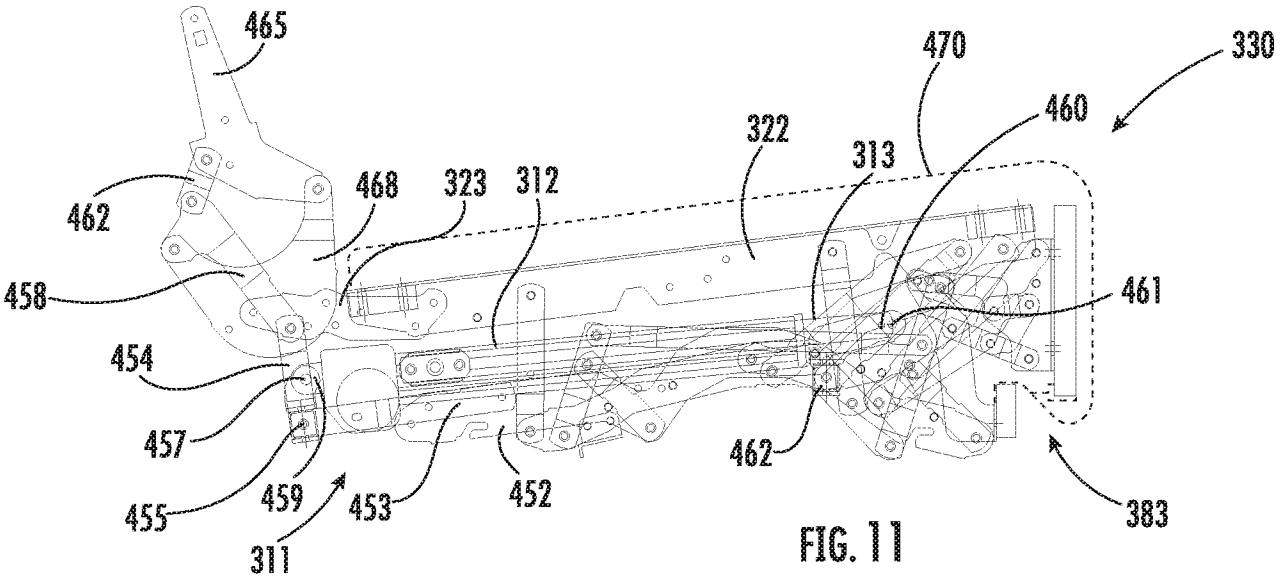
FIG. 11 is a side view of the reclining and footrest mechanism of the chair of FIG. 8 shown in the upright position.
Figure 12:
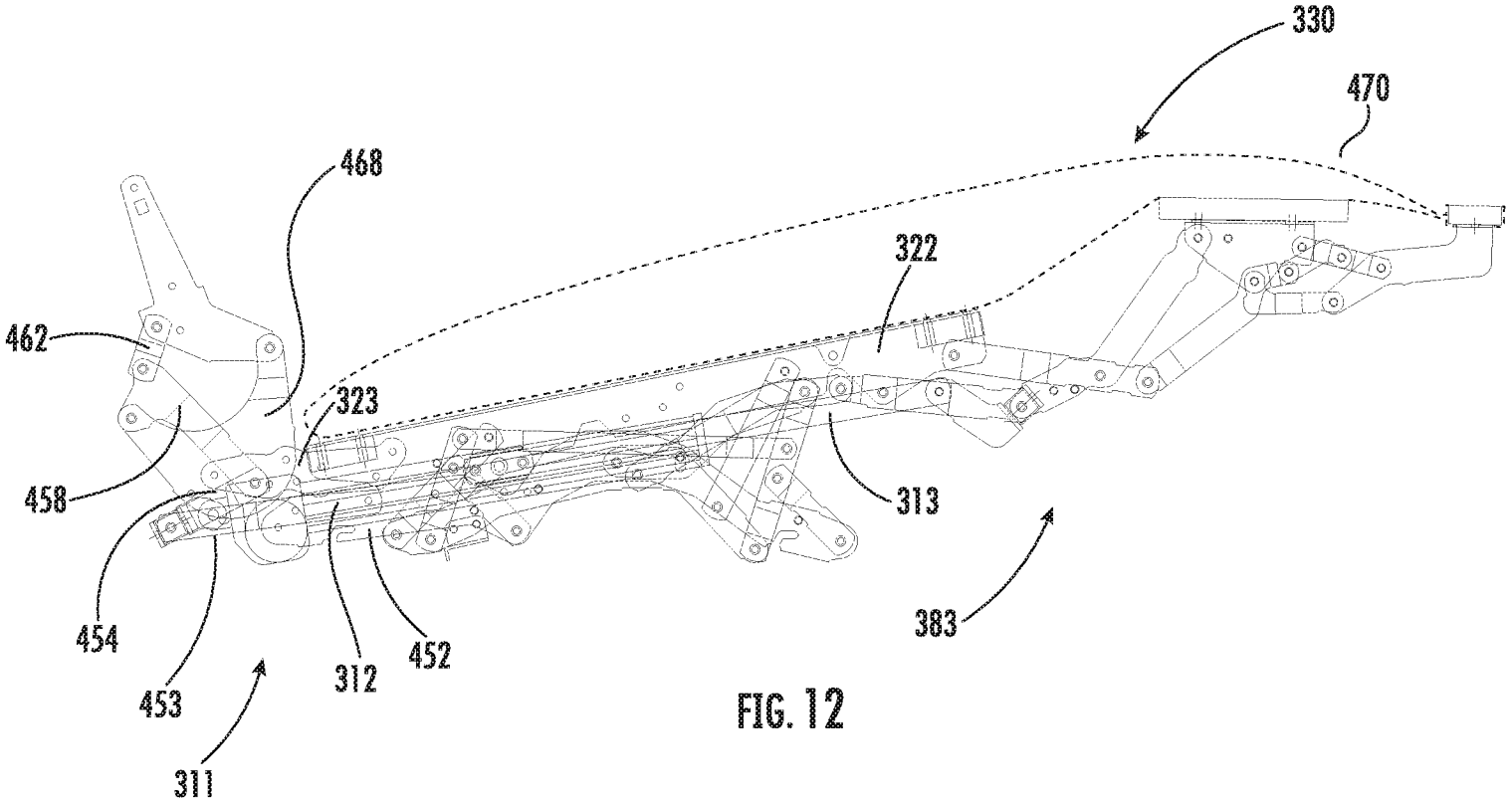
FIG. 12 is a side view of the mechanism of FIG. 11 shown in the TV position.
Figure 13:
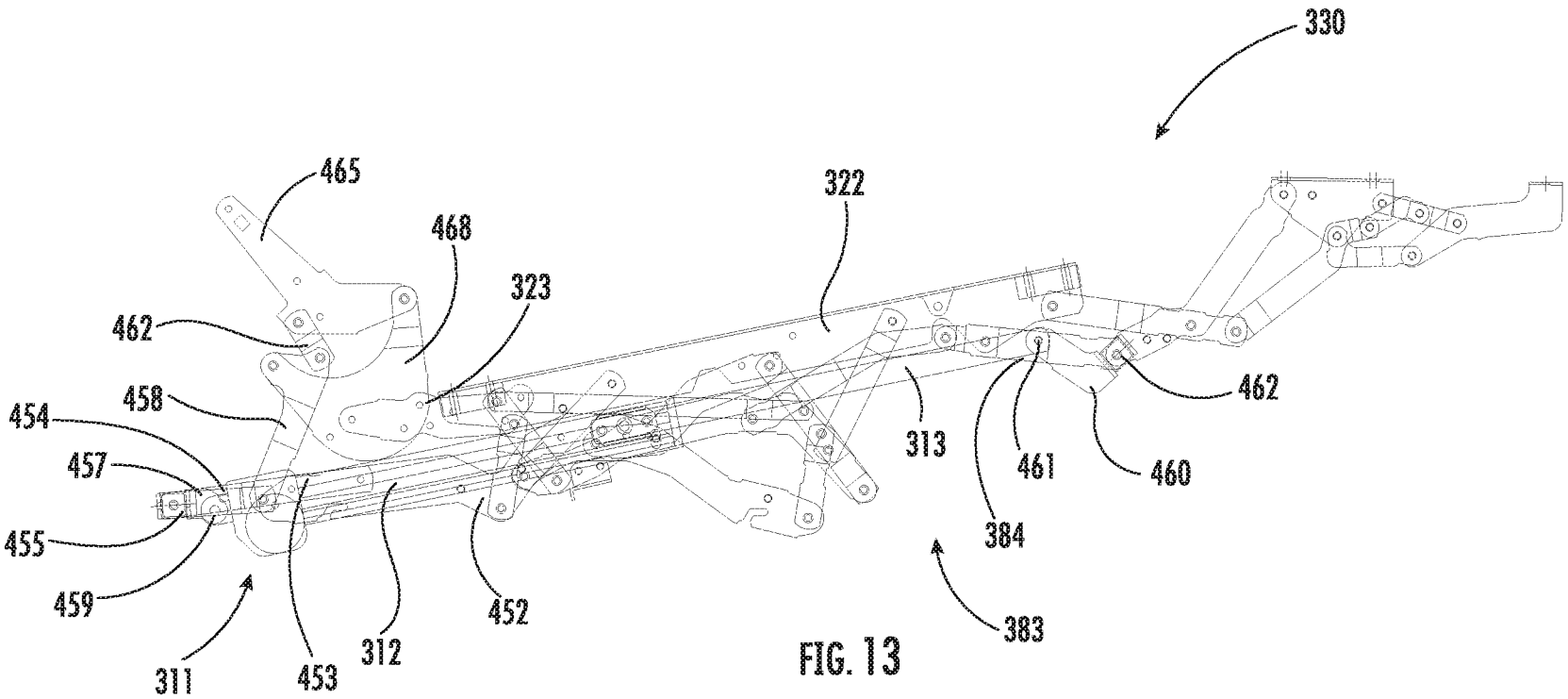
FIG. 13 is a side view of the mechanism of FIG. 11 shown in the fully reclined position.

Referring now to FIGS. 8-13, another chair, designated broadly at 310, is shown therein. The chair 310 has many elements and components that are identical or similar to those of the chair 10, but differs in at least two ways: it relies on an electric linear actuator 311 to drive the chair 310 between the upright, TV and fully reclined positions, and it provides a deeper seat (i.e., the seat 320 is longer from front to back) than the chair 10. The linear actuator 311 enables the chair 310 to be moved to any position between the upright position (FIGS. 8 and 11) and the fully reclined position (FIGS. 10 and 13). The deeper seat 320 can provide greater comfort for some individuals (particularly those who are taller). Also, when the seating unit 310 is part of a larger piece of furniture (such as a love seat, sofa, sectional sofa, or the like), a deeper seat 320 can provide more support space for occupants assuming different postures (e.g., prone, supine, sitting with feet tucked under, etc.). Below are described differences in the links comprising the reclining mechanisms 330 from those in the mechanisms 30.

Referring to FIGS. 10 and 13, which illustrate the chair 310 in the fully reclined position, it can be seen that an extension 323 is added to and extends rearwardly from the rear end of the seat frame 322. The extension 468 is fixed to the extension 323.

Also, an extension 453 is added to and extends rearwardly from the rear end of the foundation link 452. The lower rear swing link 454 is attached to the rear end of the extension 453. The upper swing link 458 is attached to the lower swing link 454 in the same manner as in the chair 10, but the upper swing link 458 is somewhat longer and more sharply angled. Also, the control link 462 (which attaches to the upper rear swing link 458 and to the backpost 465, is somewhat shorter in this embodiment.

A cross-member 455 extends between the extensions 453 on either side of the chair 310. A flange link 457 is fixed to and extends forwardly from the cross-member 455.

The linear actuator 311 includes a sleeve 312 and a reciprocating rod 313. The sleeve 312 is attached to the flange link 457 at a pivot 459. The rod 313 is attached at a pivot 461 to a finger 460 that is fixed to a cross-member 462. The cross-member 462 extends between the lower footrest swing link 384.

The linear actuator 311 and its associated links thus replace the actuating mechanism 130 of the chair 10 to move the chair 310 between the upright, TV and fully reclined positions. In the upright position of FIGS. 8 and 11, the rod 313 of the linear actuator 311 is fully retracted, such that the footrest linkage 383 is retracted and the footrests 329*a*, 329*b* are positioned under the front end of the seat 320. In the TV position of FIGS. 9 and 12, the rod 313 is extended somewhat from the sleeve 312. Extension of the rod 313 forces the lower footrest swing link 384 forward around the pivot 385 with the seat frame 322. This action of the lower footrest swing link 384 drives the remainder of the footrest linkage 383 to its extended position.

From the TV position of FIGS. 9 and 12, further extension of the rod 313 within the sleeve 312 forces the seat frame 322 forwardly in a similar manner that that described above to the fully reclined position of FIGS. 10 and 13.

Figure 14:
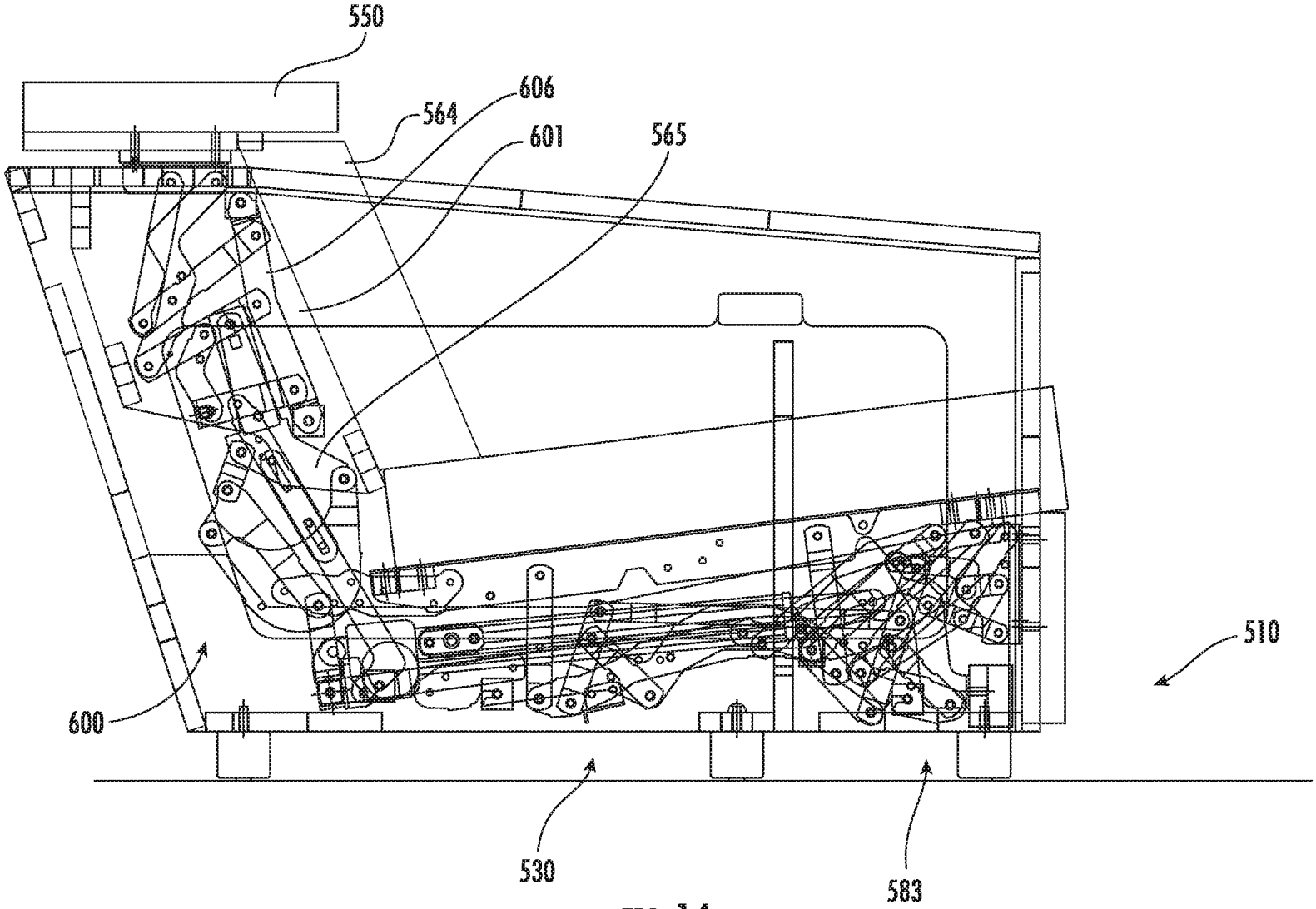
FIG. 14 is a side view of a seating unit according to additional embodiments of the invention, with the seating unit shown in its upright position and the headrest in a retracted position.
Figure 15:
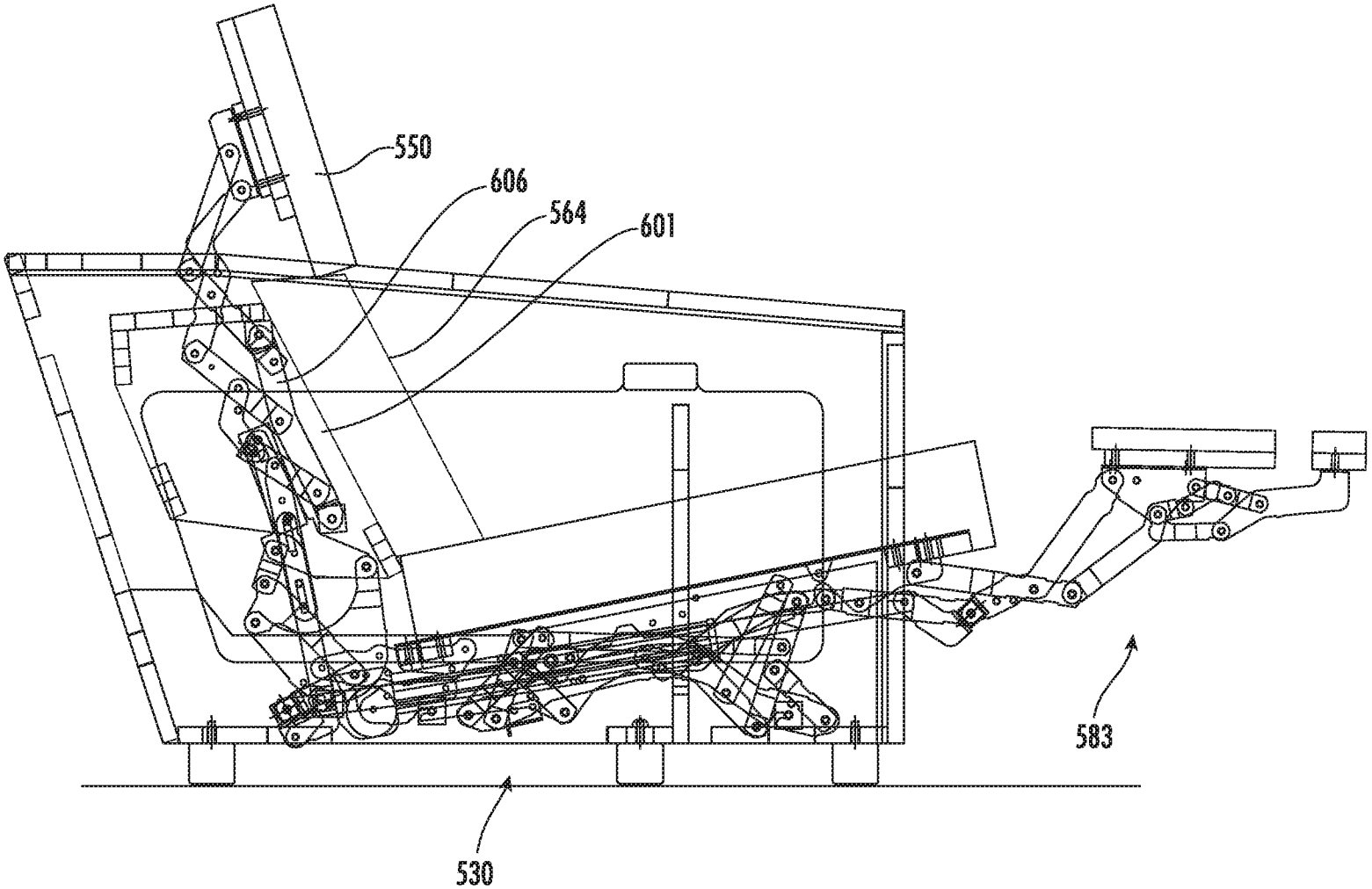
FIG. 15 is a side view of the seating unit of FIG. 14, shown in its TV position, with the headrest in an extended position.
Figure 16:
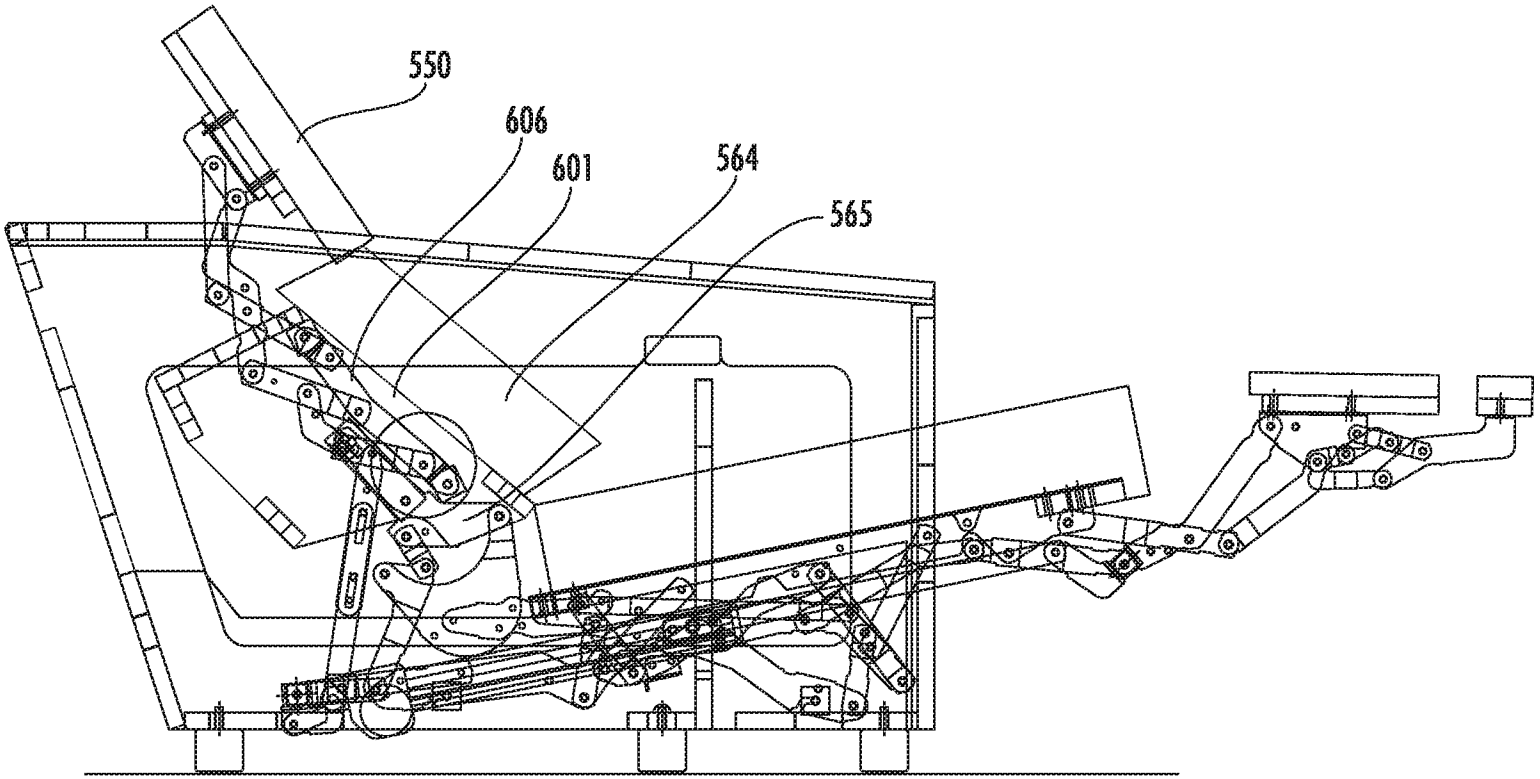
FIG. 16 is a side view of the seating unit of FIG. 14, shown in its fully reclined position, with the headrest in an extended position.
Figure 17:
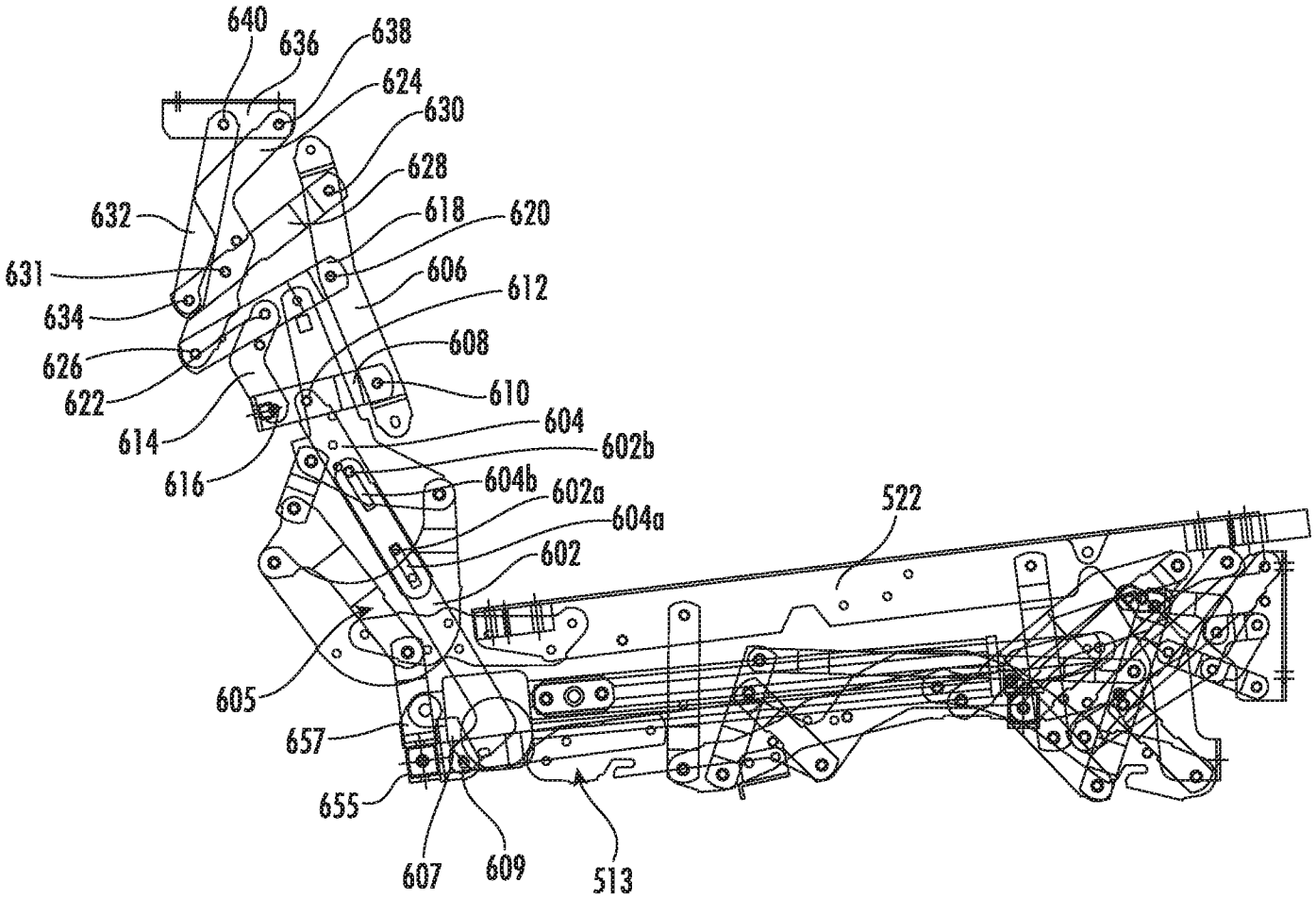
FIG. 17 is a side view of the reclining and footrest mechanism of the chair of FIG. 14 shown in the upright position.
Figure 18:
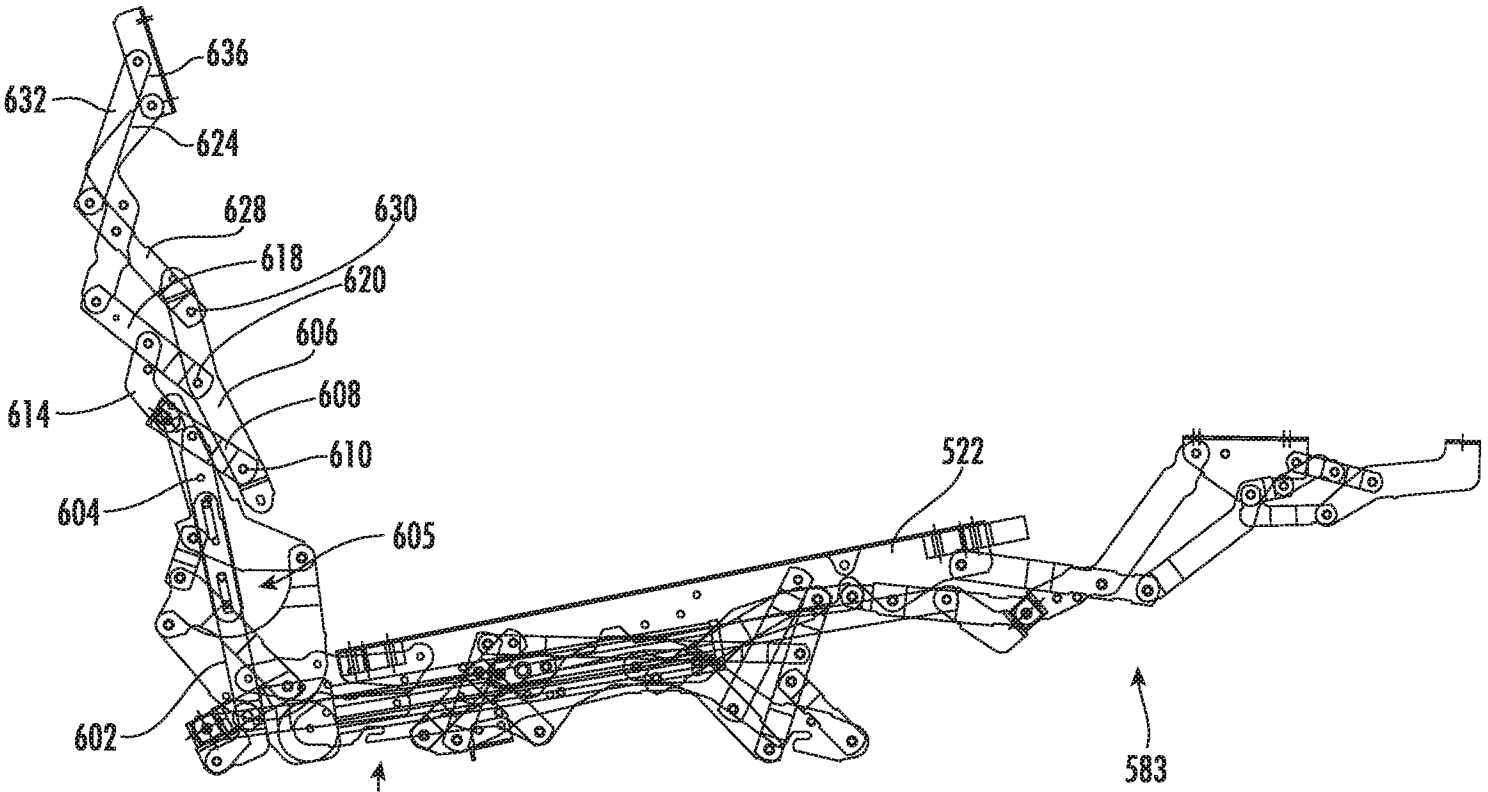
FIG. 18 is a side view of the mechanism of FIG. 14 shown in the TV position.
Figure 19:
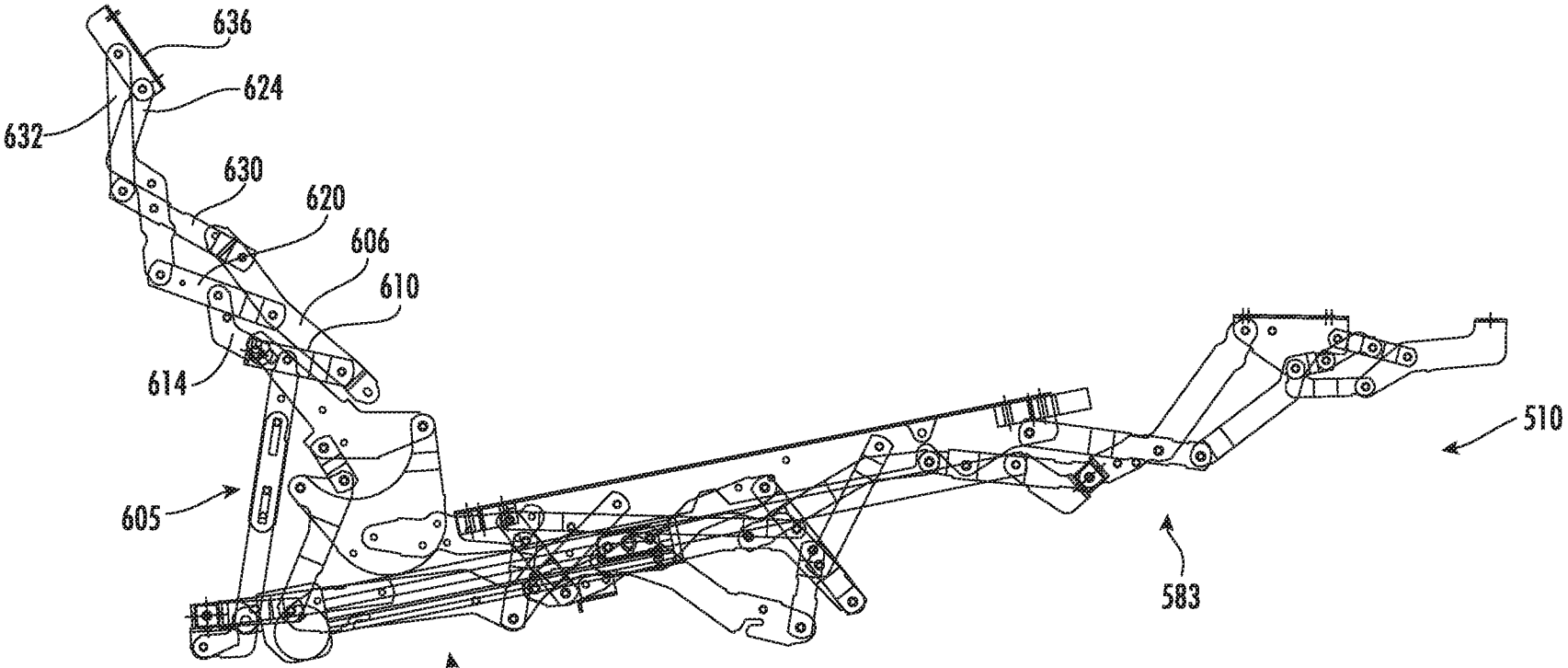
FIG. 19 is a side view of the mechanism of FIG. 14 shown in the fully reclined position.

Referring now to FIGS. 14-21, another seating unit, designated broadly at 510, is shown therein. The seating unit 510 is similar to the seating unit 310, with the exception that an extendable headrest 550 is coupled with the reclining mechanism 530. The headrest 550 moves between a retracted position, in which the headrest 550 is generally horizontal and rests atop the backrest 564, and an extended position, in which the headrest 550 is generally upright and above and generally parallel with the backrest 564. The headrest 550 is in the retracted position when the seating unit 510 is in the upright position (FIGS. 14 and 17), and in the extended position when the seating unit 510 is in the TV (FIGS. 15 and 18) and fully reclined positions (FIGS. 16 and 19). The movement of the headrest 550 is controlled by the headrest mechanism 600, (which comprises two mirror image linkages, one of which is described in detail below.

As can be seen in FIGS. 14-16, a foundation panel 601 is mounted to the rear surface of the backrest 564 and extends rearwardly therefrom. The backpost 565 is fixedly mounted near the forward edges of the foundation panels 601. A mounting link 606 is also fixed to the forward portion of each of the foundation panels 601.

Referring now to FIGS. 17-19), lower, middle and upper swing links 608, 618, 628 are pivotally attached to the mounting link 606 at pivots 610, 620, 630, respectively, and extend rearwardly therefrom. A short connecting link 614 extends between the lower and middle swing links 608, 618 and is attached at pivots 616, 622. A forward extension link 624 is attached to the middle and upper swing links 618, 628 at pivots 626, 631 and extends upwardly from the pivot 631 to attach to a headrest bracket 636 at a pivot 638. A rear extension link 632 extends from a pivot 634 with the upper swing link 628 to a pivot 640 with the headrest bracket 636.

A drive link assembly 605 includes lower and upper segments 602, 604. The lower segment 602, 604 includes two pins 602*a*, 602*b* that are received in respective slots 6004*a*, 604*b* in the upper segment 604. The pins 602*a*, 602*b* and slots 604*a*, 604*b* enable the segments 602, 604 to slide relative to each other. A spring 603 (see FIG. 20) extends between the segments 602, 604 and biases them toward each other (i.e., to a shortened overall length for the drive link assembly 605). The lower segment 602 is attached at a pivot 609 to a bracket 607 that is fixed to the cross-member 655 to which the linear actuator 513 is mounted via a flange link 657. The upper segment 604 is mounted at a pivot 612 to the lower swing link 610.

As shown in FIGS. 14 and 17, in the upright position, the headrest 550 is substantially horizontal and rests on upper edge of the backrest 564. The drive link assembly 605 is in a shortened condition, with the pins 602*a*, 602*b* in the upper ends of the slots 604*a*, 604*b*. The lower, middle and upper swing links 608, 618, 628 all extend downwardly and rearwardly from the foundation panel 601. The pivots 638, 640 are essentially level, which causes the headrest bracket 636 (and in turn the headrest 550) to be disposed horizontally. Pins on the connecting link 614 and the front extension link 624 contact edges of the middle and upper swing links 618, 628 to maintain the mechanism 600 in this position.

When the linear actuator 513 is actuated to extend, the footrest linkage 583 and the reclining linkage 530 act as described above in connection with the seating unit 310. The rear end portion of the seat frame 522 moves forwardly and downwardly, which draws the backrest 564 and the foundation panels 601 forwardly and downwardly. The drive link assembly 605 remains generally at the same elevation, but rotates slightly clockwise about the pivot 609. The downward movement of the mounting bracket 606 relative to the drive link assembly 605 causes the lower swing link 608 to pivot clockwise about the pivot 610. Rotation of the lower swing link 608 drives the connection link 614 upwardly, which forces the middle swing link 618 to pivot clockwise about the pivot 620. This action drives the front elevation link 632 upwardly, which in turn rotates the upper swing link 628 clockwise about the pivot 630. Rotation of the upper swing link 628 drives the rear extension link 632 upwardly. As the front and rear extension links 624, 632 rise, they cause the headrest bracket 636 and the attached headrest 550 to take a generally upright disposition (FIGS. 15 and 18), in which the front surface of the headrest 550 is generally parallel with the front of the backrest 564. Typically, the angle of the headrest 550 and the backrest 564 is between about 65 and 80 degrees relative to horizontal (i.e., to the floor).

As the linear actuator 513 continues to extend and moves the seating unit 510 from the TV position of FIG. 15 to the fully reclined position (FIGS. 16 and 19), the relationship between the headrest 550 and the backrest 565 remains largely the same. Thus, as the backrest 564 reclines to a shallower angle in the manner described above, so does the headrest 550 (the angle of the backrest 564 and the headrest 550 relative to horizontal is typically between about 45 and 65 degrees).

The seating unit can be returned from the fully reclined position to the TV position, and from the TV position to the upright position, by activating the linear actuator 513 to retract. As the linear actuator 513 retracts, the movements of the various links described above are simply reversed.

Figure 20:
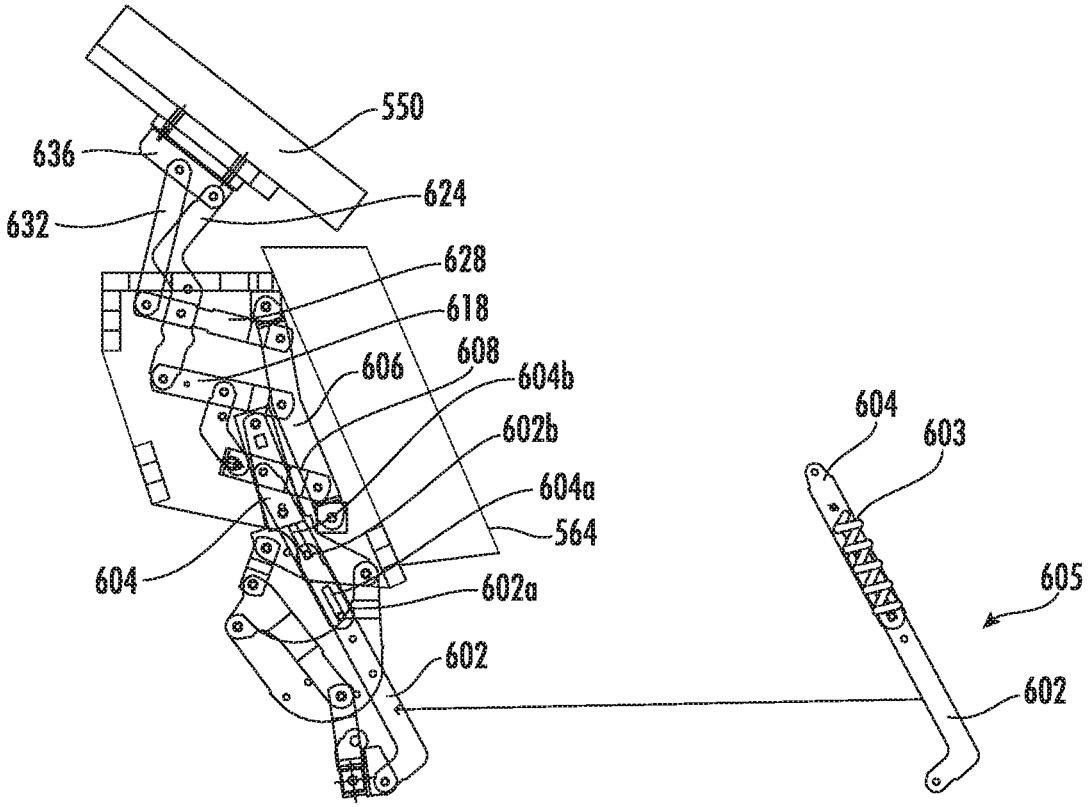
FIG. 20 is a side view of the headrest mechanism of the seating unit of FIG. 14, shown as it moves between the retracted and extended positions.
Figure 21:
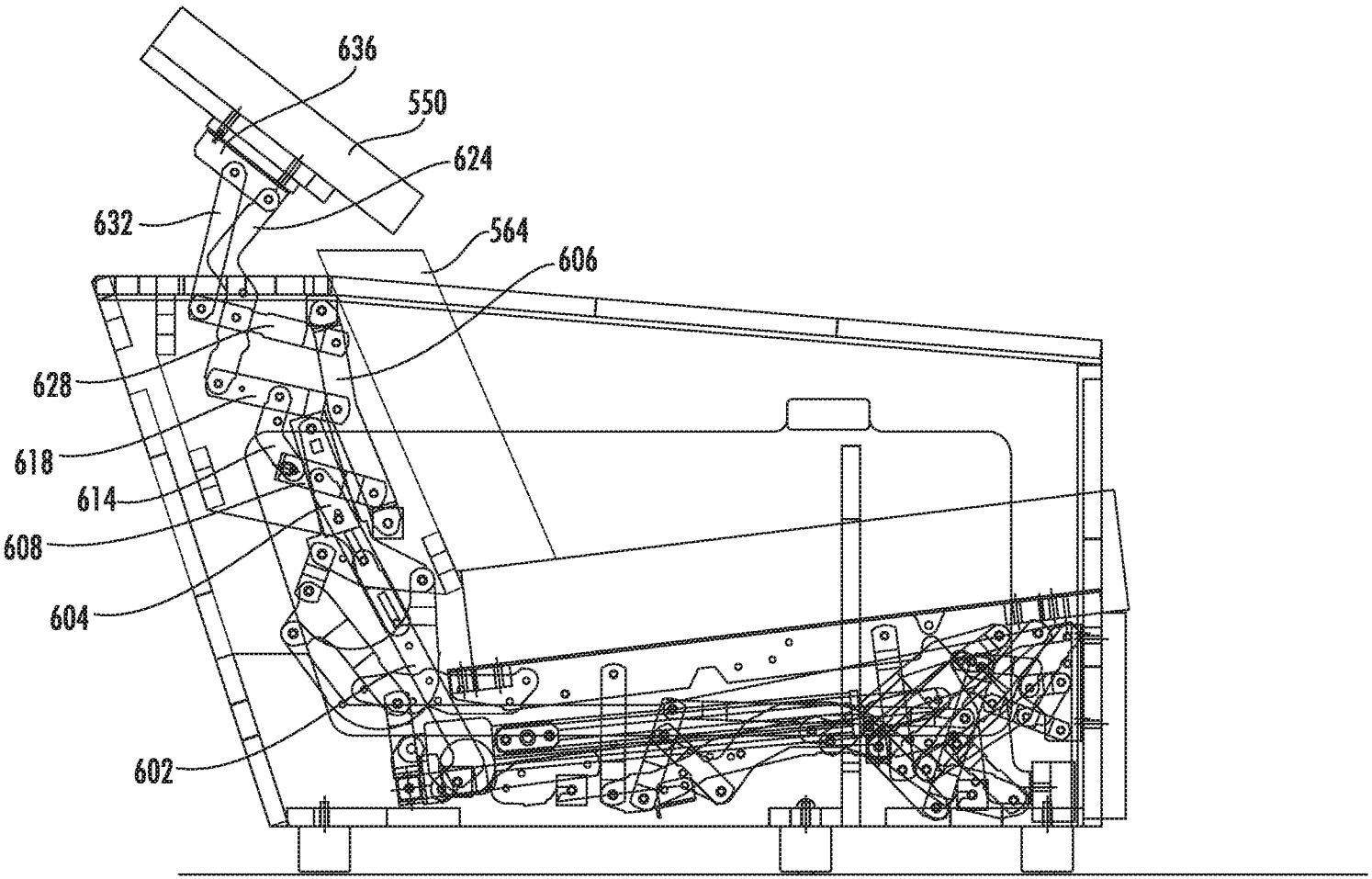
FIG. 21 is a side view of the seating unit of FIG. 14 shown in the upright position, with the headrest pivoted relative to the backrest.

It should be noted that, when the headrest 550 is in the retracted position and resting atop the backrest 564, the drive link assembly 605 has the ability to extend; i.e., the upper segment 604 can slide upwardly relative to the lower segment 602. This capability can provide a convenience feature to the seating unit 510, as the headrest 550 can pivot upwardly from the backrest 564 (resisted somewhat by the spring 603, as it biases the segments 602, 604 toward remaining retracted). This extended configuration is shown in FIG. 20. Thus, if a person, animal or object were resting on the upper surface of the rear portion of the frame as the seating unit 510 moves to the upright position, it would not be trapped against the frame by the headrest 550 as it folds into its retracted position, as the allowable movement between the segments 602, 604 enables the headrest 550 to pivot away from the frame.

It should also be noted that it can be advantageous to that the headrest mechanism 600 is coupled to the reclining mechanism 530, which drives the headrest 550 between its various positions as the seating unit 510 moves between its various positions. This arrangement can avoid the need for another actuator (which can increase cost, weight and required space) to drive the headrest between its positions.

Those of skill in this art will appreciate that seating units according to embodiments of the invention may take other forms. For example, while a chair is shown herein, the reclining mechanisms 30, 300 may be employed in other seating units, such as love seats, sofas, sectional sofas, and the like.

Also, in other embodiments the actuating mechanisms may vary as desired, including both manually-operated units and other power-actuated units. For example, the "telescoping" linear actuators shown herein may be replaced by linear actuators that have a carriage that slides along a base rail. In such an embodiment, the carriage of the actuator slides forwardly to move the seating unit from the upright position to the TV and fully reclined positions. A seating unit using such a linear actuator may take advantage of the longer "stroke" to facilitate movement of the reclining mechanism.

Further, the chairs/seating units 10, 310, 510 may have only one footrest, or may have three or more footrests in other embodiments. Other variations will be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A wall-proximity reclining seating unit, comprising:

a frame having a back member and a pair of arms, the back member extending between the arms;

a backrest;

a seat;

a first footrest;

a reclining mechanism connected between the frame, backrest, seat, and first footrest, the reclining mechanism comprising a series of pivotally interconnected links and configured to move the seating unit between: (a) an upright position, in which the backrest is disposed at a first generally upright backrest angle, the seat is disposed at a first generally horizontal seat angle, and the first footrest is retracted below a forward portion of the seat, (b) a TV position, in which the backrest substantially maintains the first backrest angle, the seat is disposed at a second seat angle that is steeper than the first seat angle, the first footrest is extended in front of the seat and is generally horizontally disposed, and the seat and backrest are moved forwardly relative to the frame; and (c) a fully reclined position, in which the backrest is disposed at a second backrest angle that is shallower than the first backrest angle, the first footrest remains extended in front of the seat, and the seat is moved forward of its position in the TV position;

a headrest; and a headrest mechanism attached to the headrest and the backrest, the headrest mechanism configured to move the headrest between a retracted position, in Which the headrest is generally horizontally disposed and overlies the backrest and the back member, and an extended position, in which the headrest is generally upright and generally parallel with the backrest, the headrest mechanism including a drive member having upper and lower segments that are slidably connected with each other, such that the headrest is free to pivot away from the retracted position while the backrest, seat and footrest remain in the upright position.

2. The reclining seating unit defined in claim 1, wherein the headrest mechanism is coupled to the reclining mechanism, and wherein the headrest takes the retracted position when the seating unit is in the upright position, and the headrest takes the extended position when the seating unit is in the TV and fully reclined positions.

3. The reclining seating unit defined in claim 1, wherein the back member is attached adjacent an upper end of the frame.

4. The reclining seating unit defined in claim 3, wherein in the fully reclined position, an upper end of the backrest is forward of the back member.

5. The reclining seating unit defined in claim 1, wherein the reclining mechanism includes a foundation link fixed to the frame and a carrier link pivotally attached with the foundation link, and wherein the seat includes a seat frame, and wherein (a) when the chair moves from the upright position to the TV position, the seat frame moves forwardly relative to the carrier link, and the carrier link is substantially stationary relative to the foundation link, and (b) when the chair moves from the TV position to the fully reclined position, the carrier link moves forwardly relative to the foundation link, and the seat frame does not move substantially forwardly relative to the carrier link.

6. The reclining seating unit defined in claim 5, wherein the seat frame includes an extension fixed to a rear portion thereof, and the backrest includes a backpost that is directly attached to the extension via a single pivot axis.

7. The reclining seating unit defined in claim 5, wherein the reclining mechanism further comprises a rear intermediate swing link and a front intermediate swing link, each of the rear intermediate swing link and the front intermediate swing link being directly pivotally interconnected between the carrier link and the seat frame.

8. The reclining seating unit defined in claim 7, wherein the reclining mechanism includes a lower rear swing link pivotally attached to the foundation link, an upper rear swing link pivotally attached to the lower rear swing link and to the extension, and a control link pivotally attached to the upper rear swing link and to the backpost.

9. The reclining seating unit defined in claim 8, wherein in the control link is inclined forwardly as it extends upwardly from the upper rear swing link to the backpost in each of the upright, TV and fully reclined positions.

10. The reclining seating unit defined in claim 1, further comprising a power actuating unit coupled to the reclining mechanism.

11. The reclining seating unit defined in claim 1, further comprising a second footrest attached to the reclining mechanism, wherein in the upright position the second footrest is disposed below the seat and behind the first footrest, and in the TV and fully reclined positions the second footrest is positioned forwardly of the first footrest, and wherein in the upright position the first footrest is vertically disposed.

12. The reclining seating unit defined in claim 11, further comprising a pad mounted to a rear edge of the seat and to the first footrest, wherein in the upright position the pad overlies a forwardmost surface of the first footrest, and in the TV and fully reclined positions the pad overlies an upper surface of the first footrest, the pad also being mounted to a lower surface of the second footrest when the seating unit is in the upright position.

* * * * *